US012196535B2

(12) United States Patent
Costa et al.

(10) Patent No.: US 12,196,535 B2
(45) Date of Patent: Jan. 14, 2025

(54) ARROW TRACKING DEVICE

(71) Applicants: Jacob Costa, Apollo, PA (US); Jared Costa, Apollo, PA (US)

(72) Inventors: Jacob Costa, Apollo, PA (US); Jared Costa, Apollo, PA (US)

( * ) Notice: Subject to any disclaimer, the term of this patent is extended or adjusted under 35 U.S.C. 154(b) by 0 days.

(21) Appl. No.: 18/147,985

(22) Filed: Dec. 29, 2022

(65) Prior Publication Data

US 2023/0204333 A1 Jun. 29, 2023

Related U.S. Application Data

(60) Provisional application No. 63/294,414, filed on Dec. 29, 2021.

(51) Int. Cl.
*F42B 6/04* (2006.01)
*F42B 12/38* (2006.01)

(52) U.S. Cl.
CPC ..... *F42B 12/385* (2013.01); *F42B 6/04* (2013.01)

(58) Field of Classification Search
CPC ..... F42B 6/04; F42B 6/06; F42B 6/08; F42B 12/385
See application file for complete search history.

(56) References Cited

U.S. PATENT DOCUMENTS

| | | | | |
|---|---|---|---|---|
| 3,915,455 | A * | 10/1975 | Savora | F42B 6/08 473/584 |
| 7,972,230 | B2 * | 7/2011 | Donahoe | F42B 6/08 473/578 |
| 9,307,300 | B2 * | 4/2016 | DiSanto | F42B 12/385 |
| 9,557,148 | B2 * | 1/2017 | Ledbetter | F42B 12/362 |
| 10,161,731 | B2 * | 12/2018 | Lish | F42B 12/362 |
| 10,443,991 | B2 * | 10/2019 | Emrich | A63B 24/0021 |
| 10,718,596 | B1 * | 7/2020 | Weston | F42B 6/04 |
| 11,289,926 | B2 * | 3/2022 | Feng | H02J 7/0047 |
| 11,828,581 | B1 * | 11/2023 | Barnett | B29C 45/14 |
| 2011/0202152 | A1 * | 8/2011 | Barton | F42B 12/385 700/91 |

* cited by examiner

*Primary Examiner* — John A Ricci
(74) *Attorney, Agent, or Firm* — Brennan, Manna & Diamond, LLC

(57) ABSTRACT

The present invention relates generally to the field of arrows. More specifically, the present invention relates to an arrow tracking device that provides a mechanism for a user to locate an arrow after it is fired. The device comprises at least one arrow, which is further comprised of an arrowhead, shaft, nock, and fletching. The shaft features a GPS transmitter, while the nock features an LED. The arrowhead may be unscrewed from the shaft to reveal a USB port, which, in turn, may be plugged into a charging base to recharge the device. The device may further comprise a mobile application so that a user can utilize and customize the electronic functions of the device. Accordingly, the present disclosure makes specific reference thereto. Nonetheless, it is to be appreciated that aspects of the present invention are also equally applicable to other like applications, devices and methods of manufacture.

16 Claims, 4 Drawing Sheets

ARROW TRACKING DEVICE

CROSS-REFERENCE TO RELATED APPLICATION

The present application claims priority to, and the benefit of, U.S. Provisional Application No. 63/294,414, which was filed on Dec. 29, 2021, and is incorporated herein by reference in its entirety.

FIELD OF THE INVENTION

The present invention relates generally to the field of arrows. More specifically, the present invention relates to an arrow tracking device that provides a mechanism for a user to locate an arrow after it is fired. The device comprises at least one arrow, which is further comprised of an arrowhead, shaft, nock, and fletching. The shaft features a GPS transmitter, while the nock features an LED. The arrowhead may be unscrewed from the shaft to reveal a USB port, which in turn may be plugged into a charging base to recharge the device. The device may further comprise a mobile application so that a user can utilize and customize the electronic functions of the device. Accordingly, the present disclosure makes specific reference thereto. Nonetheless, it is to be appreciated that aspects of the present invention are also equally applicable to other like applications, devices and methods of manufacture.

BACKGROUND

Hunters who use bows may often face the frustration of losing either their arrows, their game, or both. Replacing lost arrows can be very costly. In addition, if an animal is shot by an arrow and lost it can be costly for both the hunter and the animal. If a hunter were to hit and wound an animal, it is customary for the hunter to pursue the animal and end its suffering in the most humane way possible. If the hunter loses the animal, the animal may continue to suffer in immense pain for an extended period of time. As a result, the hunter would have lost not only the animal and their arrows, but will have also inflicted needless suffering.

Therefore, there exists a long-felt need in the art for an arrow tracking device that prevents a user from losing track of their arrows and any game shot with said arrows. There also exists a long-felt need in the art for an arrow tracking device that can be located through the use of a GPS transmitter. Moreover, there exists a long-felt need in the art for an arrow tracking device that can be located through the use of an LED. Lastly, there exists a long-felt need in the art for an arrow tracking device that can easily be recharged for repeated use.

The subject matter disclosed and claimed herein, in one embodiment thereof, comprises an arrow tracking device. The device is primarily comprised of at least one arrow further comprised of a shaft with a GPS transmitter and a nock with an LED. In addition, the shaft has a USB port that can be connected to the USB port of a charging base that charges a battery within the shaft which powers the transmitter and LED. To expose the USB port, the arrowhead may be unscrewed from the front end of the shaft. The device may also be comprised of a mobile application that allows a user to track the GPS position of the device. The location of the device can also be determined by the LED, which begins blinking when the device is shot in motion.

In this manner, the arrow tracking device of the present invention accomplishes all of the foregoing objectives and provides a mechanism to track arrows after they have been shot through the use of a GPS transmitter and an LED. Further, because the device features a battery and charging base, the device can easily be recharged for multiple uses. Lastly, because the device features a mobile application, the user has an easy way to locate their arrows and customize the display of the LED.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an arrow tracking device. The device is primarily comprised of at least one arrow further comprised of a shaft with a GPS transmitter and a nock with an LED. In addition, the shaft has a USB port that can be connected to a USB port of a charging base that charges a battery within the shaft which powers the transmitter and LED. The arrow also features fletching, which stabilizes the arrow. To reveal the USB port, the shaft may be unscrewed from the arrowhead. To provide the mechanisms to attach and detach the arrowhead from the shaft, the arrowhead and the shaft feature female and male threads, respectively.

The device features a motion sensor located on the shaft. When the motion sensor detects movement, it may initiate the GPS transmitter and the blinking or illumination of the LED light. The GPS transmitter allows a user to track their arrow to reduce the number of lost arrows, as well as to track the game that the arrow may have pierced. The LED further aids the user in locating the device. The device may also be comprised of a mobile application that displays the GPS location of each arrow of the device to a user.

Accordingly, the arrow tracking device of the present invention is particularly advantageous as it allows a user to track and locate arrows after they are shot. Additionally, the use of the GPS transmitter ensures that the device can be tracked from a mobile application for easy recovery. Moreover, the device features a charging station and rechargeable battery to ensure the device can be used repeatedly. In this manner, the arrow tracking device overcomes the limitations of existing arrows known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
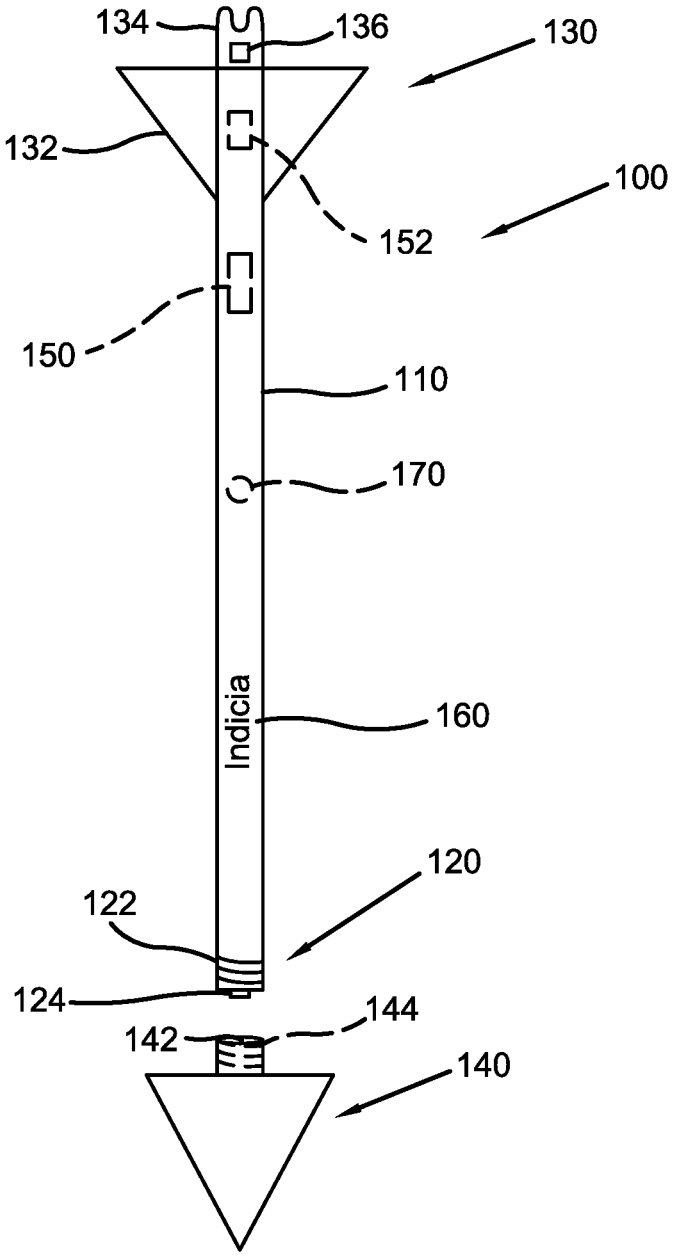
FIG. 1 illustrates a perspective view of one potential embodiment of an arrow tracking device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an arrow tracking device that provides a mechanism to prevent a user from losing their arrows and game. There also exists a long-felt need in the art for an arrow tracking device that utilizes a GPS transmitter to track and locate an arrow. Moreover, there exists a long-felt need in the art for an arrow tracking device that utilizes an LED light so a user can easily see their arrow. Lastly, there exists a long-felt need in the art for an arrow tracking device that can be recharged so that the device may be used multiple times.

The present invention, in one exemplary embodiment, is comprised of at least one arrow further comprised of a shaft with a GPS transmitter and a nock with an LED. Additionally, the shaft features a USB port that can be connected to a USB port located on a charging base. The charging base, in turn, charges a battery within the shaft, which powers the GPS transmitter and LED. The arrow also features fletching to stabilize the arrow. The arrowhead and the shaft feature female and male threads such that the arrowhead can be unscrewed from the shaft. By unscrewing the arrowhead from the shaft, the USB port is exposed, which is used to charge the device.

A motion sensor is located on the shaft of the arrow. Once the arrow is in flight, the motion sensor initiates the GPS transmitter and the blinking or illumination of the LED light. The GPS transmitter then allows the user to track their arrow so that they may recover lost arrows and locate fleeing game. The LED further aids the user in locating their arrows. Additionally, the device may be comprised of a mobile application to control the electronic functions of the device.

Referring initially to the drawings, FIG. 1 illustrates a perspective view of one potential embodiment of an arrow tracking device 100 of the present invention in accordance with the disclosed architecture. The device 100 is primarily comprised of at least one arrow 105 further comprised of a shaft 110 with a GPS transmitter 152 and a nock 134 with at least one LED 136. In addition, the shaft 110 has a USB port 124 that can be connected to the USB port 260 of a charging base 200 that charges a battery 150 within the shaft 110 which powers the transmitter 152 and LED 136. The device 100 may also be comprised of a mobile application 300.

The shaft 110 of the device 110 is generally cylindrical in shape and is preferably manufactured with wood, such as, but not limited to, cedar, pine, spruce, etc., and may be especially suited for use with a traditional recurve bow or longbow. In other embodiments, the shaft 110 may be comprised of more durable materials, such as, but not limited to, aluminum, carbon fiber, fiberglass, etc., for use in modern compound bows or crossbows. To enhance the appearance of the device 100, the shaft 110 may be comprised of a plurality of decorative indicia 160, such as, but not limited to: patterns, logos, emblems, images, symbols, designs, letters, words, characters, animals, advertisements, brands, etc. The second end 130 of the shaft 110 is fastened with fletching 132, which stabilizes the shaft 110 when the arrow 105 is shot by causing the shaft 110 to spin while in flight. The fletching 132 has at least one vane, but preferably three or four vanes, which may be manufactured in either feathers or a plastic material. The fletching 132 may be manufactured in a multitude of different lengths, thicknesses, and shapes known in the art.

The first end 120 of the shaft 110 is comprised of male threads 122 such that the shaft 110 may be screwed into the female opening 142 of the arrowhead 140, which has corresponding female threads 144. The male threads 122 on the first end 120 of the shaft 110 engage the female threads 144 on the opening 142 of the arrowhead 140 to attach or detach (i.e., unscrew) the arrowhead 140 from the shaft 110. The arrowhead 140 may be any arrowhead 140 known in the art, such as, but not limited to: auriculate, lanceolate, leaf, triangle, basal notched, corner notched, side-notched, contracting stem, expanding stem, stemmed, bifurcated, mechanical blade broadheads, bullet point, blunt point, bodkin point, broadhead point, field point, fish point, JUDO point, target point, excurvated, incurvate, inward recurvate, outward recurvate, serrated, straight, safety point, etc. The arrowhead 140 is preferably manufactured in a hard, durable material that is lightweight such as, but not limited to, aluminum or stainless steel. Any of the aforementioned shaped arrowheads 140 may be manufactured in any material known in the art.

The shaft 110 and the arrowhead 140 may be unscrewed from each other to reveal a USB port 124 located on the first end 120 of the shaft 110. The USB port 124 may then connect to a charging base 200 with a corresponding USB port 260 to provide power to a battery 150 located on the shaft 110. The battery 150, in turn, may power the GPS transmitter 152 and LED 136. In different embodiments, the battery 150 may be a disposable battery 150 or a rechargeable battery 150 in the form of an alkaline, nickel-cadmium, nickel-metal hydride battery, etc., such as, any 3V-12 volts DC battery 246 or other conventional battery 150 such as A, AA, AAA, etc. that supply power to the device. Throughout this specification the terms "battery." "battery pack," and "batteries" may be used interchangeably to refer to one or more wet or dry cells or batteries 150 of cells in which chemical energy is converted into electricity and used as a source of DC power. References to recharging or replacing batteries 150 may refer to recharging or replacing individual cells, individual batteries 150 of cells, or a package of multiple battery cells as is appropriate for any given battery technology that may be used.

The shaft 110 has a GPS transmitter 152 and a nock 134, which is further comprised of an LED 136. The nock 134 is fastened to the second end 130 of the shaft and serves as the attachment point to place the arrow 105 on a bowstring. The GPS transmitter 152 is located within the shaft 110 and may be augmented with a motion sensor 170 that is in communication with the GPS transmitter152 and the LED 136. Once the arrow 105 has been shot and the motion sensor 170 registers movement above a certain threshold speed (ex. 10 mph), the motion sensor 170 activates both the GPS transmitter 152 and lights up the LED 136. The GPS transmitter 152 allows the user to track the arrow 105 after it has been shot into any game, or simply to locate a wayward arrow. The LED 136 may also aid the user in finding arrows 105, or even tracing them through the air if shot at night. The LED 136 is preferably fastened to the outside of the nock 134. In different embodiments, the nock 134 may be transparent and the LED 136 may be inside the nock 134. The LED 136 may be programmed to light up in any color known in the art, or in any pattern of multiple colors and may either blink, flash, or remain on indefinitely once the motion sensor 170 detects motion above a threshold speed value (ex. 10 mph) and any point thereafter.

Figure 2:
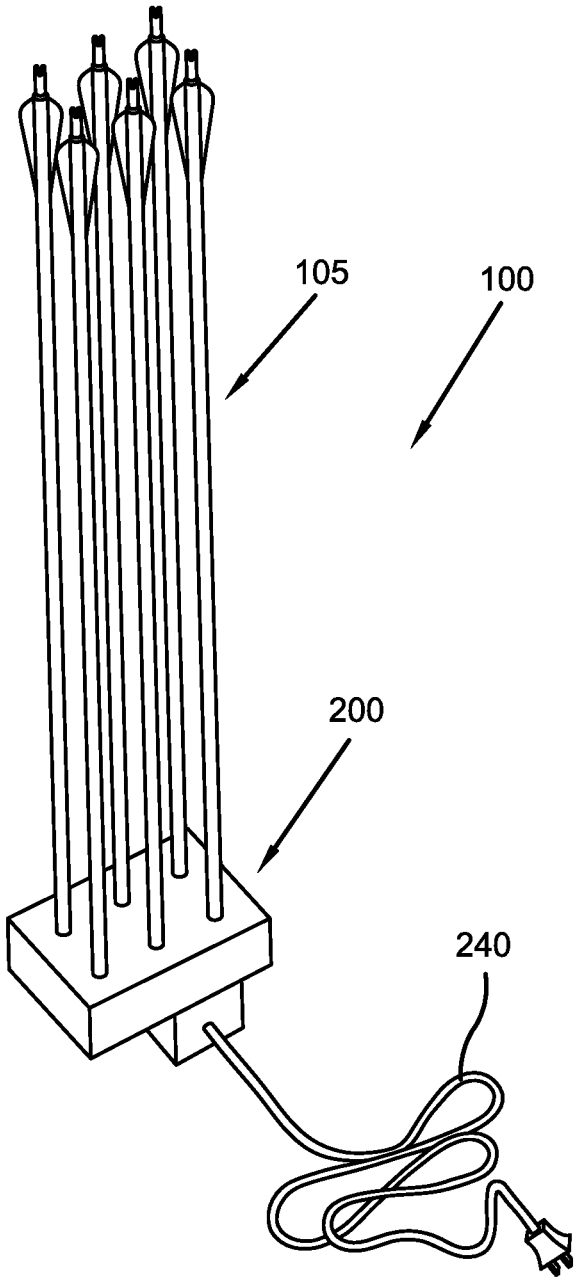
FIG. 2 illustrates a perspective view of one potential embodiment of an arrow tracking device of the present invention in accordance with the disclosed architecture.

FIG. 2 illustrates a perspective view of one potential embodiment of an arrow tracking device 100 of the present invention in accordance with the disclosed architecture. When the arrowhead 140 is unscrewed from the shaft 110, at least one charging base 200 may receive at least one arrow 105 through a connection between the USB port 124 on the shaft 110 and the USB port 160 on the charging base 200. The device's 100 charging base 200 receives its power through the power cord 240. The power cord 40 is preferably a male power cord 250 that may be plugged into most standard 110-volt or 240-volt wall outlets.

Figure 3:
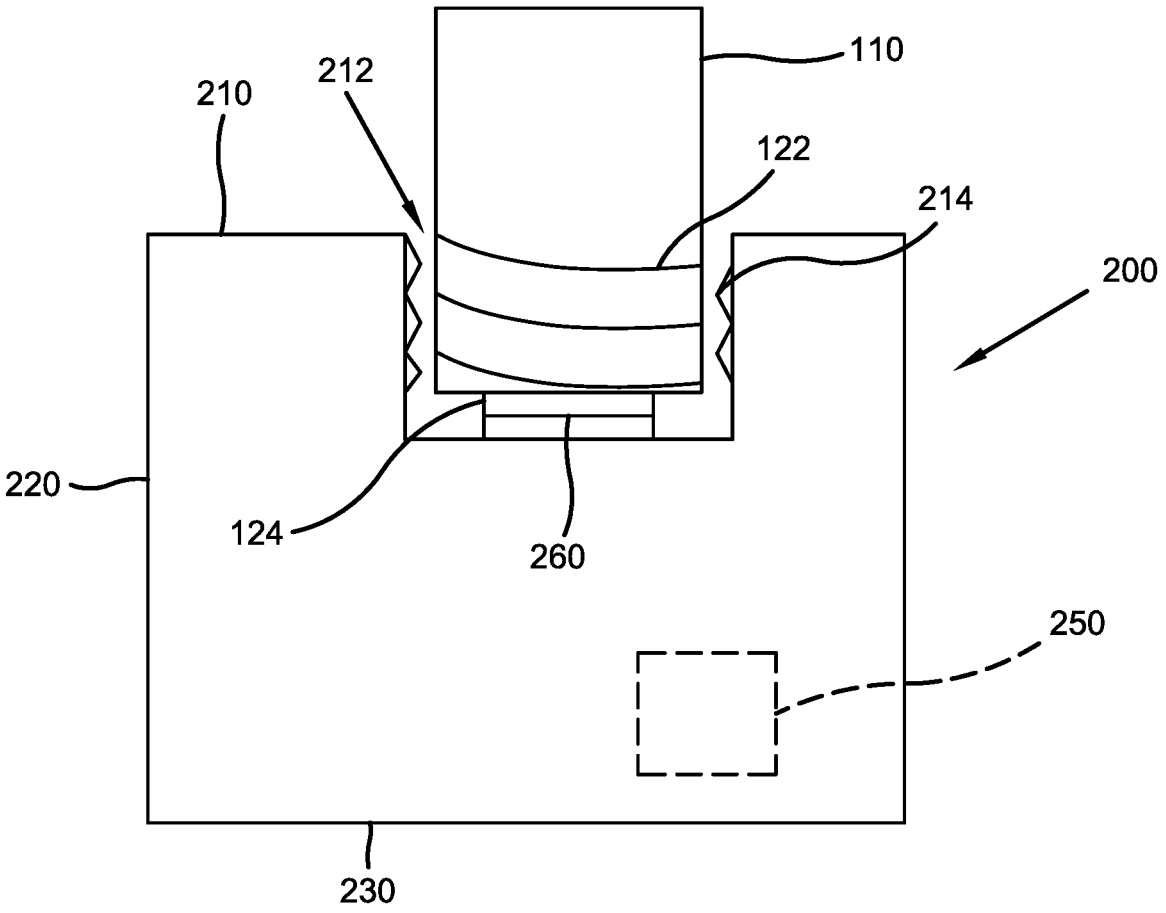
FIG. 3 illustrates an enhanced perspective view of one potential embodiment of an arrow tracking device of the present invention in accordance with the disclosed architecture.

FIG. 3 illustrates an enhanced perspective view of one potential embodiment of an arrow tracking device 100 of the present invention in accordance with the disclosed architecture. The top surface 210 of the charging base 200 has at least one opening 212, which receives the shaft 110 of the arrow 105. The USB port 124 on the shaft 110 may be plugged into the USB port 260 on the charging base 200 to begin transferring power from the charging base 200 to the battery 150. To secure each arrow 105 shaft 110, the openings 212 of the charging base 200 feature a plurality of female threads 214 which receive the corresponding plurality of male threads 122 located on the first end 120 of the shaft 110. The male threads 122 on the first end 120 of the shaft 110 engage the female threads 214 on the charging base 200 to attach or detach the shaft 110 from the charging base 200. The USB ports 124, 260 may be any type of USB port 124, 260 known in the art, such as, but not limited to: USB-A, USB-B, Micro-B, Micro-USB, Mini-USB, USB-C. Further, both ports 124,260 may be male and/or female ports in differing embodiments of the device 100. In different embodiments, the charging base 200 may retain a battery 250 charge such that is remains operable when transported away from outlets. The bottom surface 130 of the charging base 200 may be manufactured from a rubber material that prevents slippage/movement of the charging base 200.

Figure 4:
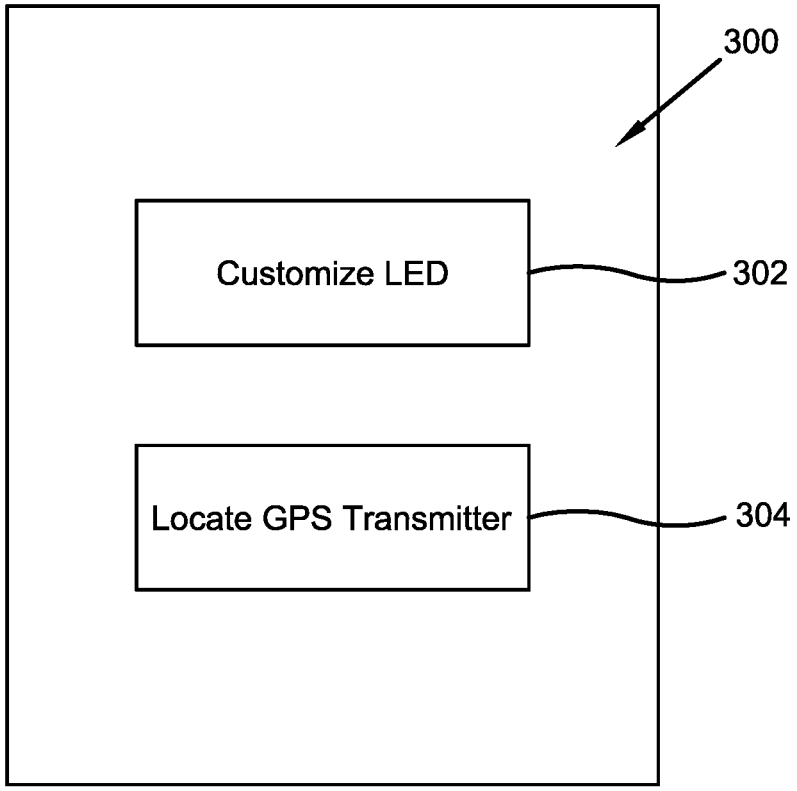
FIG. 4 illustrates a graphical view of primary features of one potential embodiment of a mobile application of one potential embodiment of an arrow tracking device of the present invention in accordance with the disclosed architecture.

FIG. 4 illustrates a graphical view of primary features of one potential embodiment of a mobile application 300 of one potential embodiment of an arrow tracking device 100 of the present invention in accordance with the disclosed architecture. The mobile application 300 is in wireless electrical communication with the GPS transmitter 152 and the LED 136. The wireless electrical communication may be accomplished through any wireless electrical communication types known in the art, such as, but not limited to: Wi-Fi, Bluetooth, NFC, Infrared, radio frequency, Cellular Data, etc. The mobile application 300 has a plurality of functions. The mobile application 300 may contain a function to locate the GPS transmitter 304. This may display a satellite map of the surrounding area with the exact location of the arrow 105. The mobile application 300 also may contain a function to customize the LED 136 intensity 302. This may allow the user to brighten or reduce the vibrancy of the LED 136. The mobile application 300 may also allow the user to customize other functions of the device 100, such as the LED's 136 colors and blinking pattern. The mobile application 300 may allow a user to customize each arrow 105 individually with their own unique settings to differentiate arrows from different users.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "arrow tracking device" and "device" are interchangeable and refer to the arrow tracking device 100 of the present invention.

Notwithstanding the forgoing, the arrow tracking device 100 of the present invention and its various components can be of any suitable size and configuration as is known in the art without affecting the overall concept of the invention, provided that they accomplish the above-stated objectives. One of ordinary skill in the art will appreciate that the size, configuration and material of the arrow tracking device 100 as shown in the FIGS. are for illustrative purposes only, and that many other sizes and shapes of the arrow tracking device 100 are well within the scope of the present disclosure. Although the dimensions of the arrow tracking device 100 are important design parameters for user convenience, the arrow tracking device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An arrow tracking device comprising:

an arrow comprised of a shaft having a first end and a second end, a plurality of male threads positioned on the first end and a fletching and a nock positioned on the second end;

an arrowhead further comprised of an opening having a plurality of female threads for mating engagement with the plurality of male threads;

a GPS transmitter;

a motion sensor;

a battery;

an LED;

a charging base comprising a plurality of female threads;

a first USB port positioned on the shaft and a second USB port positioned on the charging base, wherein the first USB port engages with the second USB port; and an application in wireless communication with the GPS transmitter; and wherein the charging base charges the battery, and further wherein the battery is attached to the shaft; and wherein the plurality of male threads of the shaft matingly engage with the plurality of female threads on the charging base.

2. The arrow tracking device of claim 1, wherein the motion sensor activates the GPS transmitter and the LED when a motion of the shaft is detected above a threshold speed.

3. The arrow tracking device of claim 1, wherein the shaft is manufactured from a wood material.

4. A arrow tracking device comprising:

an arrow comprised of a shaft having a first end and a second end, a plurality of male threads and a first USB port positioned on the first end and a fletching and a nock positioned on the second end;

an arrowhead further comprised of an opening having a plurality of female threads for mating engagement with the plurality of male threads;

a GPS transmitter;

a battery attached to the shaft;

an LED;

a charging base comprising a plurality of female threads, a second USB port, and a power cord configured to recharge the battery; and an application in wireless communication with the GPS transmitter; and wherein the first USB port engages with the second USB port; and wherein the plurality of male threads of the shaft matingly engage with the plurality of female threads on the charging base.

5. The arrow tracking device of claim 4, wherein the nock is comprised of a transparent material.

6. The arrow tracking device of claim 5, wherein the LED is located within the nock.

7. The arrow tracking device of claim 4 further comprising a motion sensor that is activated when a motion of the arrow is detected above a threshold speed.

8. The arrow tracking device of claim 7, wherein the motion sensor activates the GPS transmitter and illuminates the LED.

9. A arrow tracking device comprising:

an arrow comprised of a shaft, a fletching and a nock;

an arrowhead removably attached to the shaft;

a GPS transmitter;

a battery;

a charging base;

a first USB port positioned on the shaft and a second USB port positioned on the charging base, and further wherein the first USB port engages with the second USB port; and an application in wireless communication with the GPS transmitter; and wherein the battery is attached to the shaft and the charging base recharges the battery; and wherein the shaft further comprises a plurality of male threads that matingly engage with a plurality of female threads on the charging base.

10. The arrow tracking device of claim 9 further comprising an LED, wherein the application can be used to change at least one of an intensity, a color and an operation of the LED.

11. The arrow tracking device of claim 9, wherein the GPS transmitter is in wireless communication with the application via a Wi-Fi, a Bluetooth, an NFC, an infrared, a radio frequency, or a cellular data connection.

12. The arrow tracking device of claim 9, wherein the application displays a location of the GPS transmitter and the shaft via a satellite map.

13. The arrow tracking device of claim 9, wherein the shaft is manufactured from a select one of an aluminum, a carbon fiber and a fiberglass material.

14. The arrow tracking device of claim 9, wherein the battery is positioned on the shaft and a second battery is positioned on the charging base, and further wherein the second battery charges the battery without the charging base having to be plugged into a power supply.

15. The arrow tracking device of claim 9, wherein a bottom surface of the charging base is manufactured from a rubber material.

16. The arrow tracking device of claim 9, wherein the arrowhead is a select one of an auriculate, a lanceolate, a leaf, a triangle, a basal notched, a corner notched, a side-notched, a contracting stem, an expanding stem, a stemmed, a bifurcated, a mechanical blade broadhead, a bullet point, a blunt point, a bodkin point, a broadhead point, a field point, a fish point, a JUDO point, a target point, an excurvated, an incurvate, an inward recurvate, an outward recurvate, a serrated, a straight, or a safety point arrowhead.

* * * * *